United States Patent [19]

Nishikawa et al.

[11] Patent Number: 4,623,857

[45] Date of Patent: Nov. 18, 1986

[54] DIELECTRIC RESONATOR DEVICE

[75] Inventors: Toshio Nishikawa, Nagaokakyo; Youhei Ishikawa, Kyoto; Hidekazu Wada; Koichi Takehara, both of Nagaokakyo, all of Japan

[73] Assignee: Murata Manufacturing Co., Ltd., Japan

[21] Appl. No.: 812,235

[22] Filed: Dec. 23, 1985

[30] Foreign Application Priority Data

| | | | |
|---|---|---|---|
| Dec. 28, 1984 | [JP] | Japan | 59-279203 |
| May 31, 1985 | [JP] | Japan | 60-119491 |
| May 31, 1985 | [JP] | Japan | 60-119492 |

[51] Int. Cl.[4] ..... H01P 7/10; H01P 7/06

[52] U.S. Cl. ..... 333/219; 333/202; 333/227; 333/229

[58] Field of Search ..... 333/202, 208, 209, 219, 333/227, 229, 230, 231, 235, 210–212, 245, 248

[56] References Cited

U.S. PATENT DOCUMENTS

| | | | |
|---|---|---|---|
| 2,890,421 | 6/1959 | Currie | 333/208 |
| 4,423,397 | 12/1983 | Nishikawa et al. | 333/219 |

FOREIGN PATENT DOCUMENTS 119650 10/1978 Japan .

*Primary Examiner*—Marvin L. Nussbaum

*Attorney, Agent, or Firm*—Ostrolenk, Faber, Gerb & Soffen

[57] ABSTRACT

A dielectric resonator device which includes dielectric resonators constituted by a rectangular cavity shield casing and a composite dielectric structure formed by three dielectric members intersecting at right angles with each other to be combined into one unit and disposed in the rectangular cavity shield casing to provide three resonances by $TM_{110}$ modes or modified modes thereof which are utilized by the dielectric resonators, and an external coupling device for coupling the dielectric resonators with external circuits.

10 Claims, 22 Drawing Figures

DIELECTRIC RESONATOR DEVICE

BACKGROUND OF THE INVENTION

The present invention generally relates to a dielectric resonator device and more particularly, to a dielectric resonator device which utilizes resonance of $TM_{110}$ mode in a rectangular cavity (referred to merely as $TM_{110}$ mode hereinafter) or modified modes thereof.

With respect to a filter employing $TM_{110}$ mode, there has conventionally been disclosed, for example, in Japanese Patent Laid-Open Publication (Tokkaisho) No. 53-119650, a filter in which resonators, each including a linear and single cylindrical or rectangular dielectric member as one stage resonator, are combined by the required number of stages in a casing functioning as a shield casing.

By the known arrangement as referred to above, however, there has been a limitation in responding to the demands for compact size and low cost which are the everlasting requests in the field of electrical communication equipment.

Meanwhile, for example, in a transmitting and receiving equipment for a base station of a mobile communication system, there is employed a channel filter which includes, as shown in FIG. 21, filters F1, F2, . . . and Fn in plurality which allow signals only of corresponding channels CH1, CH2, . . . and CHn to pass therethrough, and cables and the like for connecting output sides of said filters F1 to Fn. For the respective filters, cavity resonators, $TE_{01\delta}$ dielectric resonator, $TM_{010}$ dielectric resonator or the like are employed. In any case, since it is so arranged that the filters in plurality in the form of one unit for each channel are further combined to constitute the channel filter, there has been a strong request for reduction in size.

SUMMARY OF THE INVENTION

Accordingly, an essential object of the present invention is to provide an improved dielectric resonator device which is compact in size and stable in functioning for application, for example, to a filter such as a channel filter or the like.

Another important object of the present invention is to provide a dielectric resonator device of the above described type which is simple in construction, and can be readily manufactured at low cost.

In accomplishing these and other objects, according to one preferred embodiment of the present invention, there is provided a dielectric resonator device which includes dielectric resonators constituted by a rectangular cavity shield casing and a composite dielectric structure formed by three dielectric members intersecting at right angles with each other to be combined into one unit and disposed in said rectangular cavity shield casing to provide three resonances by $TM_{110}$ modes or modified modes thereof which are utilized by said dielectric resonators, and an external coupling means for coupling said dielectric resonators with external circuits.

By the arrangement of the present invention as described above, external dimensions of the dielectric resonator device are advantageously reduced by the fact that the solid dielectric members having dielectric constant much larger than that of air are present in the respective directions of electric lines of force of triply degenerated $TM_{110}$ mode which is the resonant mode in the lowest order of the rectangular cavity resonator.

In another aspect of the present invention, the external coupling means referred to above includes a first external coupling means coupled with the first dielectric resonator, a second external coupling means coupled with the second dielectric resonator, a third external coupling means coupled with the third dielectric resonator, and a fourth external coupling means coupled with said first, second and third dielectric resonators.

By the above arrangement of the present invention, in the dielectric resonator device having the reduced size as described earlier, the signal applied to the first external coupling means is outputted from the fourth external coupling means, and the signal applied to the second external coupling means is outputted from the fourth external coupling means, while the signal applied to the third external coupling means is taken out from the fourth external coupling means. It is needless to say that the device may be used in the reverse order, and in that case, the signal applied to the fourth external coupling means is outputted from the first, second and third external coupling means according to the resonant frequencies of the respective dielectric resonators.

In a further aspect of the present invention, the external coupling means includes an input coupling means and an output coupling means each having magnetic coupling loops. The input coupling means is so arranged that a direction of magnetic lines of force generated in the loop is coincident with that of magnetic lines of force of the resonant mode to be coupled, while the output coupling means is so adapted that the loop interlinks the magnetic lines of force of the resonant mode to be coupled.

By the above arrangement of the present invention, in the device having the reduced size as explained earlier, the necessary mode and the external circuits are coupled to each other by the external coupling means having simple construction.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
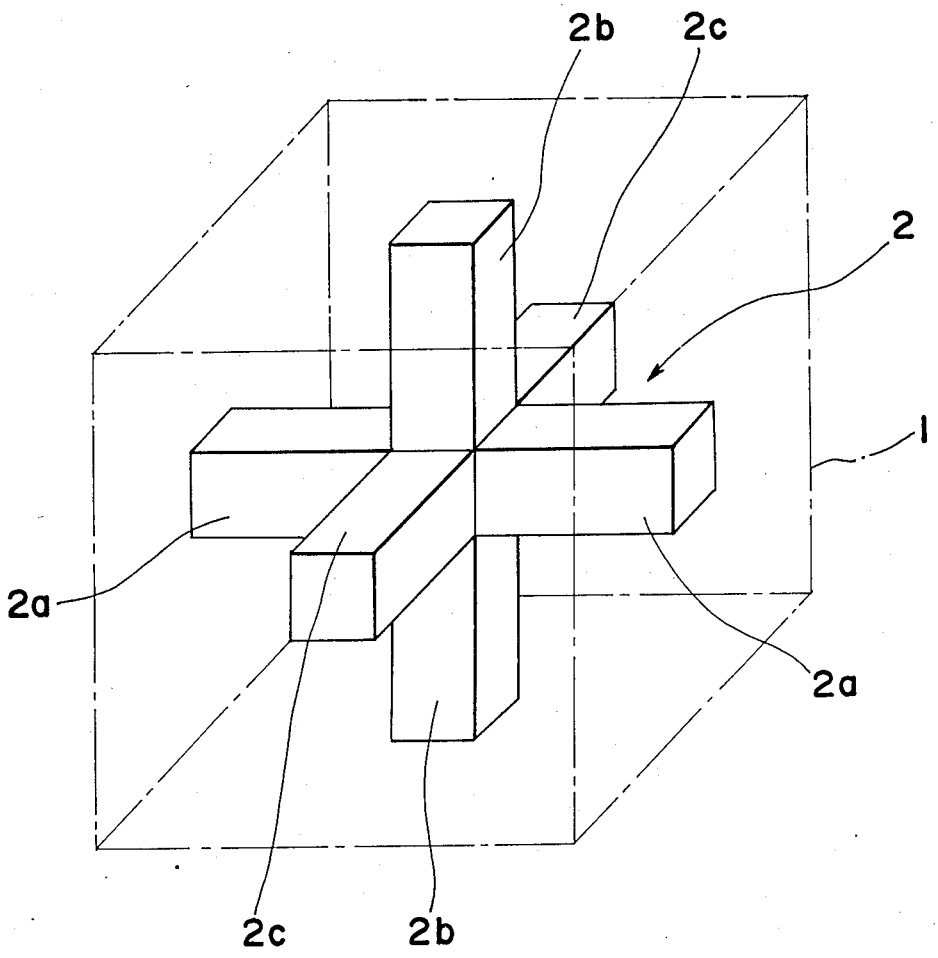
FIG. 1 is a schematic perspective view for explaining a fundamental construction of a dielectric resonator device according to the present invention.

Before the description of the present invention proceeds, it is to be noted that like parts are designated by like reference numerals throughout the accompanying drawings.

Referring now to the drawings, there is shown in FIG. 1, a fundamental construction of a dielectric resonator device according to the present invention, which generally includes a rectangular cavity shield casing 1 and a composite dielectric structure 2 which is formed by three dielectric members 2*a*, 2*b* and 2*c* each having a square cross section and intersecting at right angles with each other to be combined into one unit, and is disposed within said shield casing 1. It is to be noted that the composite dielectric structure 2 as illustrated is shown in an ideal form in which partial deformation applied from the viewpoint of processing technique is omitted therefrom. For the casing 1, there may be employed a metallic casing or such a casing as is prepared by providing a shield electrode film on an inner surface or outer surface of a rectangular cavity made of, for example, the same $(ZrSn)TiO_4$ ceramic as that for said composite dielectric structure 2. In any case, the opposite ends in the respective axial directions of the composite dielectric structure are required to be held in a state of electrically good contact with the casing 1 or the shield electrode film. In the above construction, $(ZrSn)TiO_4$ ceramic used for the composite dielectric structure 2 has the dielectric constant $\epsilon$ at 37.5 and material temperature coefficient ($\eta_f = -\alpha - \frac{1}{2}\eta\epsilon$) at $0 \pm 0.5$ ppm/°C.

By the construction of the present invention as described so far, the size of the resonator device could be reduced substantially to $\frac{1}{3}$ as compared with the conventional filter employing $TM_{110}$ mode, with advantages of known filters such as high unloaded factor Q, reduction in size, etc. still being maintained.

Incidentally, referring to FIGS. 2 through 4 for explaining double mode resonances, on the assumption that a composite dielectric structure 3 formed by two pillar-like dielectric members 3*a* and 3*b* intersecting at right angles with each other in the form of a cross so as to be combined into one unit, is provided within a rectangular cavity, the difference thereof from the present invention will be discussed hereinafter.

Figure 2:
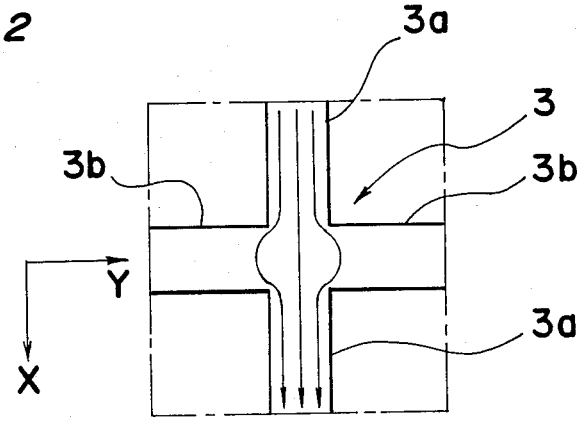
FIGS. 2 through 4 are diagrams of explaining double mode resonances.
Figure 3:
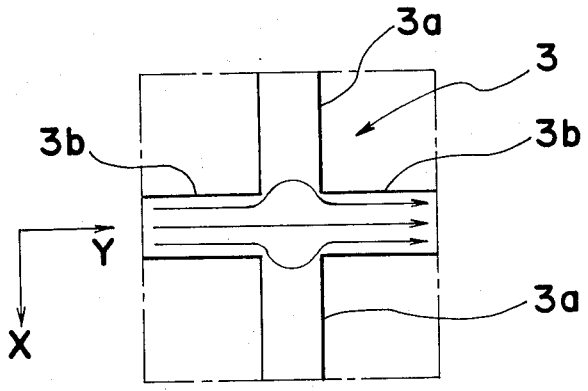
Figure 4:
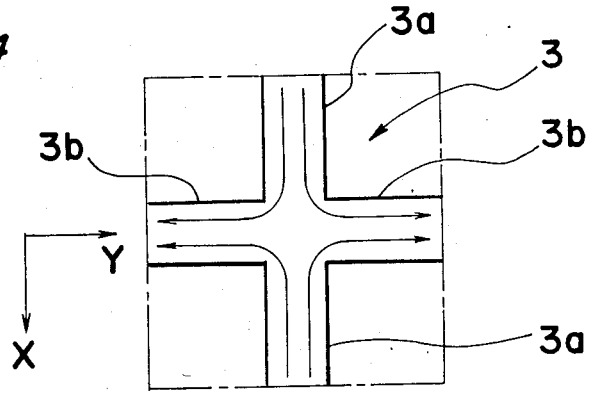

In the constructions as shown in FIGS. 2 through 4, the dielectric members 3*a* and 3*b* are effectively working on $TM_{110}$ mode in which the electric lines of force are directed in the direction of an X axis as shown in FIG. 2, and also on $TM_{110}$ mode in which the electric lines of force are directed in the direction of a Y axis as illustrated in FIG. 3. However, at the same time, since the higher order modes as shown in FIG. 4 are also present in approximately the same frequency as that for the above fundamental mode, there is a difficulty for the practical applications.

If the construction as described above is referred to as a double mode resonator, then the arrangement as in the present invention described earlier may be called a triple mode resonator.

In such triple mode resonator, since electric lines of force in the higher order run in a Z axis direction as well as in the X and Y axis directions, the frequency becomes considerably lower than that of the fundamental mode so as to be negligible in the actual application, and in this respect, the triple mode resonator may be considered to be advantageous.

Figure 5:
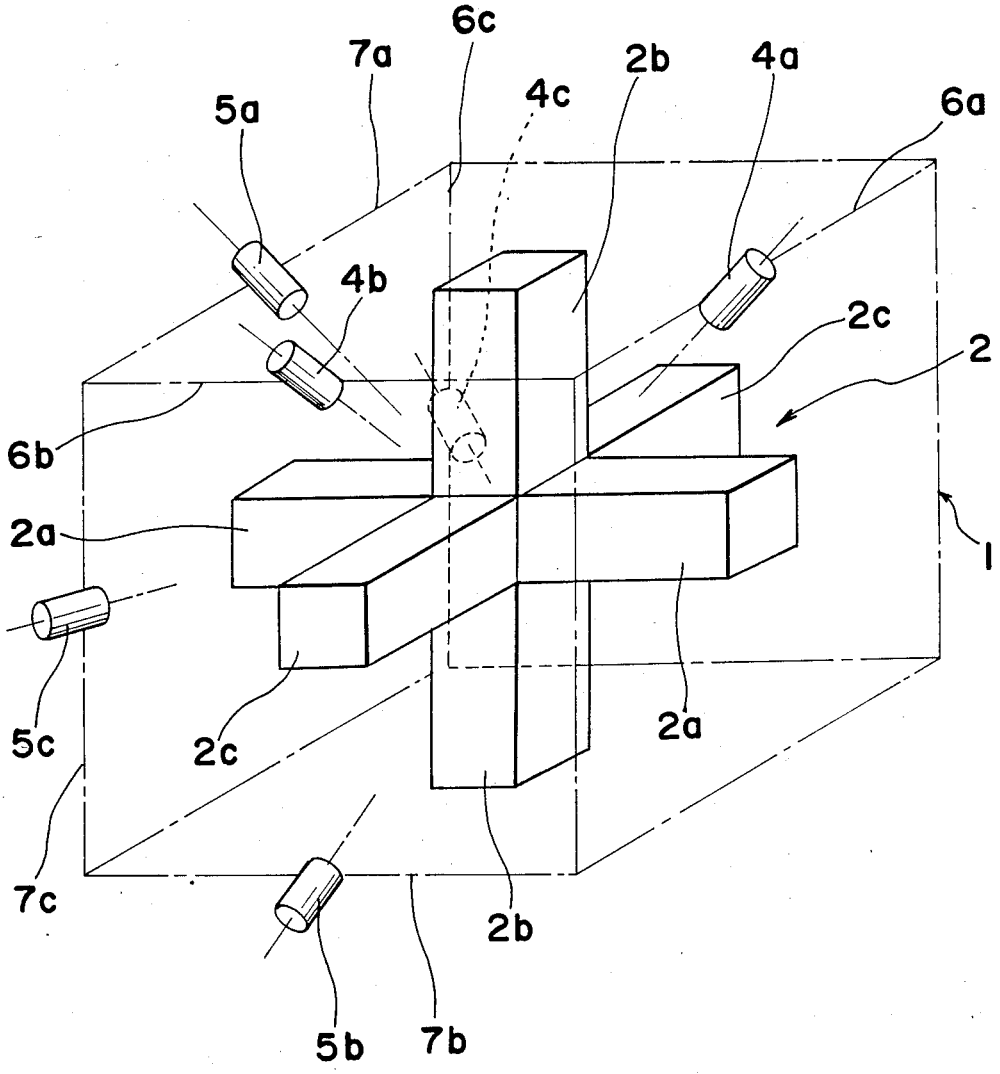
FIG. 5 is a schematic perspective view for explaining construction at essential portions of the dielectric resonator device of the present invention.

Now, in the case where products are prepared through application of the present invention, it is possible that the electromagnetic fields of the three $TM_{110}$ modes interfere with each other from the aspect of processing techniques, and in such a case, countermeasures as shown in FIG. 5 may be employed. More specifically, in FIG. 5, in order to prevent mutual interference between the electromagnetic fields of $TM_{110}$ mode to which the dielectric members 2*a* and 2*b* are respectively related, it is so arranged that coupling adjusting members 4*a* and 5*a* in the form of a pair of screw-like metallic pieces are caused to project into the casing 1 through angled edges 6*a* and 7*a* of said casing in a plane containing both of the dielectric members 2*a* and 2*b*.

Figure 6:
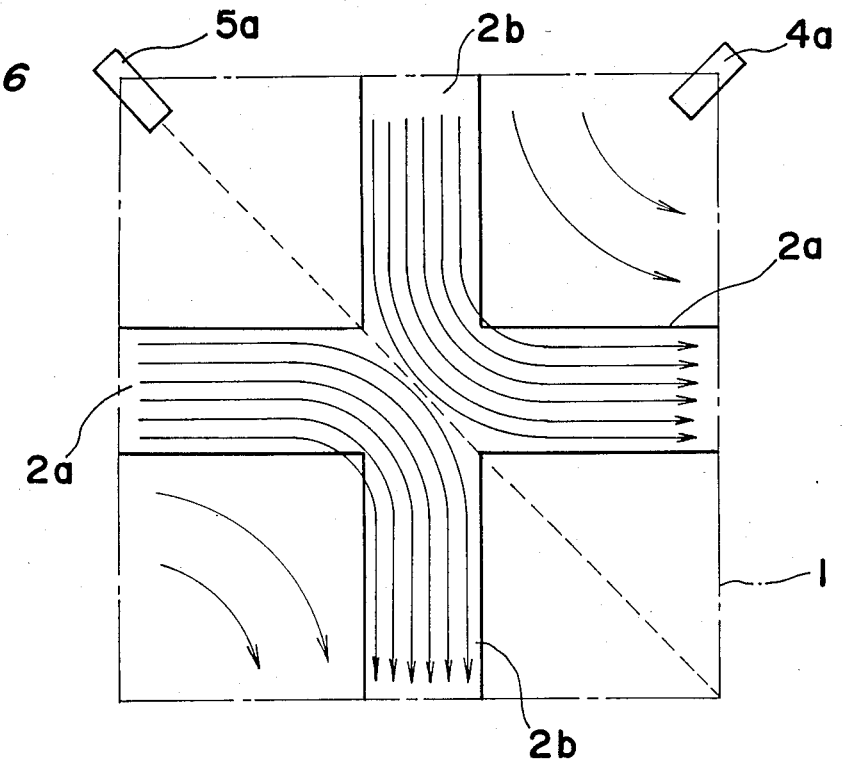
FIGS. 6 and 7 are diagrams for explaining functioning modes of the device of FIG. 5.
Figure 7:
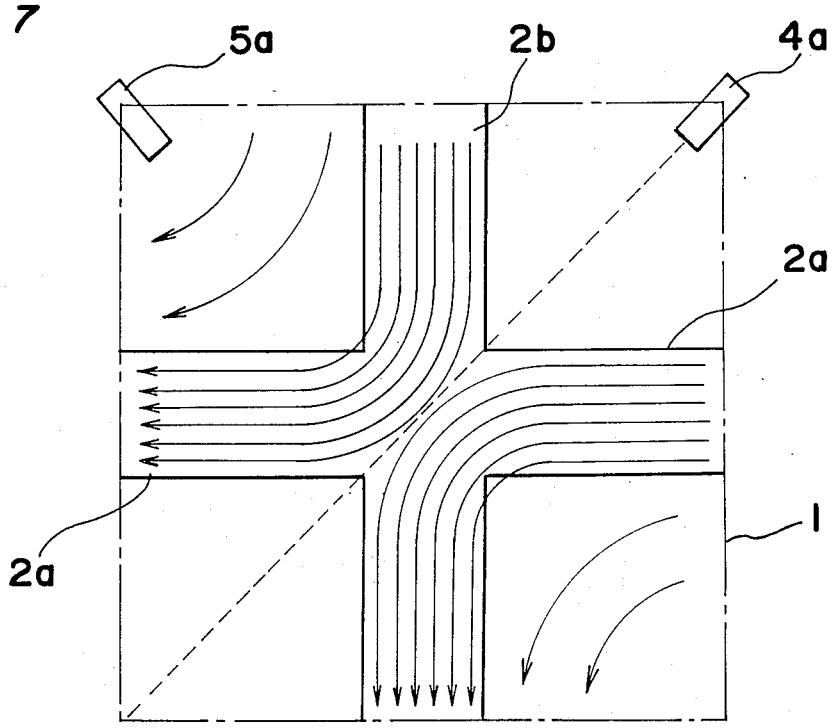

For discussing coupling between $TM_{110}$ modes to which the dielectric members 2*a* and 2*b* are respectively related, odd mode and even mode in the form of distributions of electric lines of force as shown in FIGS. 6 and 7 may be brought into consideration.

Incidentally, when an average value of the electromagnetic energy stored in the resonant system is represented by $\tilde{W}t$, the magnetic energy included at a very small portion in which the metallic piece is inserted is denoted by $\Delta\tilde{W}m$, while the electric energy included in the very small portion in which the metallic piece is inserted is shown by $\Delta\tilde{W}e$, and an equation as follows may be established.

$$\frac{\Delta\omega}{\omega_0} = \frac{\Delta\tilde{W}m - \Delta\tilde{W}e}{\tilde{W}t}$$

As is seen from the above equation of perturbation, the frequency is increased when a metallic piece is inserted into a portion where the magnetic field is strong, while it is decreased upon insertion of the metallic piece in a portion where the electric field is strong. With respect to the odd mode shown in FIG. 6, the magnetic energy is stronger than the electric energy in the vicinity of the coupling adjusting member 4a, while on the contrary, the electric energy is stronger than the magnetic energy in the vicinity of the coupling adjusting member 5a. Accordingly, as the degree of insertion of the coupling adjusting member 4a is increased, the resonant frequency of the odd mode is raised, whereas it is lowered as the degree of insertion of the coupling adjusting member 5a is increased. Meanwhile, in the even mode as shown in FIG. 7, contrary to the case of the odd mode described so far, the electric energy is stronger than the magnetic energy in the vicinity of the coupling adjusting member 4a, while in the neighborhood of the coupling adjusting member 5a, the magnetic energy is stronger than the electric energy. Accordingly, as the degree of insertion of the coupling adjusting member 4a is increased, the resonant frequency of the even mode is lowered, whereas as the degree of insertion of the coupling adjusting member 5a is increased, the resonant frequency for the even mode is raised. Therefore, if the resonant frequency for the odd mode is made equal to that for the even mode through insertion or withdrawal of the coupling adjusting members 4a and 5a, the coupling becomes substantially zero.

In order to prevent the mutual interference between the electromagnetic fields of $TM_{110}$ modes to which the dielectric members 2b and 2c are respectively related, it may be so arranged that coupling adjusting members 4b and 5b (FIG. 5) similar to the coupling adjusting members 4a and 5a are adapted to project into the casing 1 through angled edges 6b and 7b of said casing in a plane containing both of the dielectric members 2b and 2c. Furthermore, for preventing the mutual interference between the electromagnetic fields of $TM_{110}$ modes to which the dielectric members 2c and 2a are respectively related, it may be so arranged that coupling adjusting members 4c and 5c similar to the coupling adjusting members 4a and 5a or 4b and 5b are adapted to project into the casing 1 through angled edges 6c and 7c of said casing in a plane containing both of the dielectric members 2c and 2a.

In short, by taking the odd mode and even mode as described earlier into consideration, coupling adjusting members may be disposed in such positions as will affect these modes. Therefore, the coupling adjusting members need not necessarily be provided in pair, and they may be formed, for example, by coating metallic films on dielectric members.

As described so far, when the arrangement is so made that the triple modes do not interfere with each other, it may be regarded that three resonators electrically intersecting at right angles with each other are accommodated in one casing.

Conversely, in the case where the resonant frequency of the odd mode is differentiated from that of the even mode by the degree of insertion of the respective coupling adjusting members, coupling corresponding to the above difference value may be obtained between both modes. Accordingly, if three modes are coupled to each other, the filter of three stagees can be obtained as described later.

Incidentally, for actual application, the dielectric resonator of the present invention as described so far is provided with coupling means with respect to external circuits as described hereinbelow.

Figure 8:
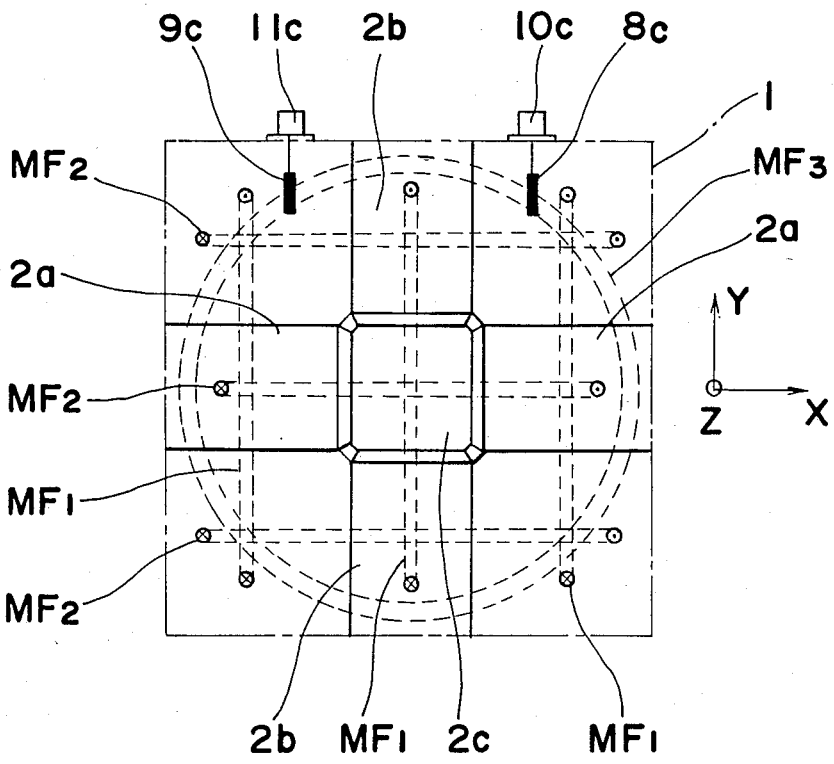
FIG. 8 is a diagram for explaining magnetic coupling loops in the dielectric resonator device according to one preferred embodiment of the present invention.
Figure 9:
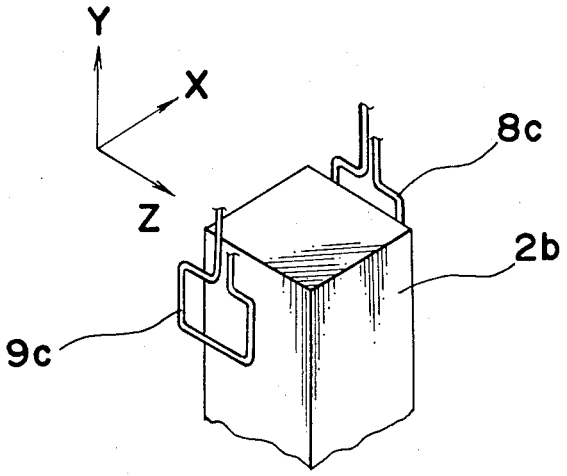
FIG. 9 is a fragmentary perspective view showing the magnetic coupling loops in the arrangement of FIG. 8.

Referring to FIGS. 8 and 9, there are representatively shown a magnetic coupling loop 8c possessed by an input coupling means, and a magnetic coupling loop 9c possessed by an output coupling means which are coupled only with the dielectric member 2c.

Now, when axial directions of the dielectric members 2a, 2b and 2c are respectively aligned with X, Y and Z axes of a rectangular coordinate, the loops 8c and 9c are disposed adjacent to one end of the dielectric member 2b in a spaced relation from the surface of said dielectric member 2b in the direction of the X axis, with said member 2b being held between the loops 8c and 9c as shown. In this case, planes in which the loops 8c and 9c are included, are directed to intersect at right angles with the X axis. One end of each of the loops 8c and 9c is connected, for example, to a central conductor of a coaxial connector 10c and 11c, respectively, while the other end thereof is connected to the ground. By the input signal applied to the input coaxial connector 10c, electric current flows through the loop 8c, and upon observation of the direction of the magnetic lines of force thus produced, direction of magnetic lines of force MF1 of the resonant mode related to the dielectric member 2a, direction of magnetic lines of force MF2 of the resonant mode related to the dielectric member 2b, and direction of magnetic lines of force MF3 of the resonant mode related to the dielectric member 2c respectively, only the magnetic lines of force MF3 have the same direction component for coupling. Accordingly, in the case where the frequency component of the resonant mode related to the dielectric member 2c is present in the signal applied to the input coaxial connector 10c, the resonance phenomenon takes place.

Meanwhile, since the magnetic lines of force MF3 of the resonant mode related to the dielectric member 2c and the loop 9c interlink each other, an output is produced from the coaxial connector 11c. However, due to the fact that the loop 9c does not interlink the magnetic lines of force MF1 of the resonant mode related to the dielectric member 2a and the magnetic lines of force MF2 of the resonant mode related to the dielectric member 2b, electromagnetic energy thereof is not derived from the coaxial connector 11c.

Figure 10:
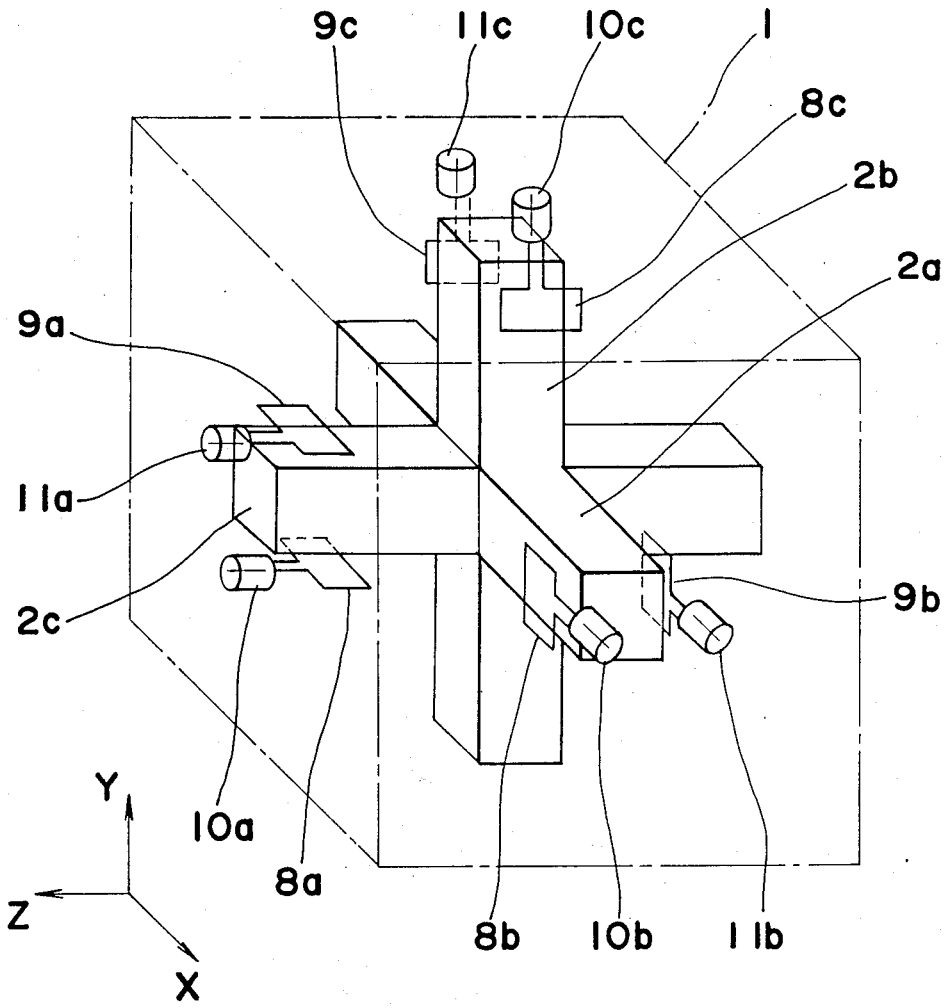
FIG. 10 is a perspective view specifically showing internal construction of the dielectric resonator device of FIG. 8.

As shown in FIG. 10, similar coupling means is also provided with respect to the dielectric member 2b. The magnetic coupling loop possessed by the input coupling means related to the dielectric member 2b is represented by a numeral 8b, and that possessed by the output coupling means related thereto is denoted by a numeral 9b. The loops 8b and 9b are disposed adjacent to one end of the dielectric member 2a in a spaced relation from the surface of said dielectric member 2a in the direction of the Z axis, with said member 2a being held between the loops 8b and 9b as shown. In this case, planes in which the loops 8b and 9b are included, are directed to intersect at right angles with the Z axis. One end of each of the loops 8b and 9b is connected, for example, to a central conductor of a coaxial connector 10b and 11b, respectively, while the other end thereof is connected to the ground. By the input signal applied to the input coaxial connector 10b, electric current flows through the loop 8b, and upon observation of the direction of magnetic lines of force thus produced, direction of magnetic lines of force MF1 of the resonant mode related to the dielectric member 2a, direction of magnetic lines of force MF2 of the resonant mode related to the dielectric member 2b, and direction of magnetic lines of force MF3 of the resonant mode related to the dielectric member 2c respectively, only the magnetic lines of force MF2 have the same direction component for coupling. Accordingly, in the case where the frequency component of the resonant mode related to the dielectric member 2b is present in the signal applied to the input coaxial connector 10b, the resonance phenomenon takes place.

Meanwhile, since the magnetic lines of force MF2 of the resonant mode related to the dielectric member 2b and the loop 9b interlink each other, an output is produced from the coaxial connector 11b. However, due to the fact that the loop 9b does not interlink the magnetic lines of force MF1 of the resonant mode related to the dielectric member 2a and the magnetic lines of force MF3 of the resonant mode related to the dielectric member 2c, electromagnetic energy thereof is not derived from the coaxial connector 11b.

Furthermore, another similar means to the above is also provided with respect to the dielectric member 2a. The magnetic coupling loop possessed by the input coupling means related to the dielectric member 2a is represented by a numeral 8a, and that possessed by the output coupling means related thereto is denoted by a numeral 9a. The loops 8a and 9a are disposed in a spaced relation from the surface of said dielectric member 2c in the direction of the Y axis, with said member 2c being held between the loops 8a and 9a. In this case, planes in which the loops 8a and 9a are included, are directed to intersect at right angles with the Y axis. One end of each of the loops 8a and 9a is connected, for example, to a central conductor of a coaxial connector 10a and 11a, respectively, while the other end thereof is connected to the ground. By the input signal applied to the input coaxial connector 10a, electric current flows through the loop 8a, and upon observation of the direction of magnetic lines of force thus produced, direction of magnetic lines of force MF1 of the resonant mode related to the dielectric member 2a, direction of magnetic lines of force MF2 of the resonant mode related to the dielectric member 2b, and direction of magnetic lines of force MF3 of the resonant mode related to the dielectric member 2c respectively, only the magnetic lines of force MF1 have the same direction component for coupling. Accordingly, in the case where the frequency component of the resonant mode related to the dielectric member 2a is present in the signal applied to the input coaxial connector 10a, the resonance phenomenon takes place.

Meanwhile, since the magnetic lines of force MF1 of the resonant mode related to the dielectric member 2a and the loop 9a interlink each other, an output is produced from the coaxial connector 11a. However, due to the fact that the loop 9a does not interlink the magnetic lines of force MF2 of the resonant mode related to the dielectric member 2b and the magnetic lines of force MF3 of the resonant mode related to the dielectric member 2c, electromagnetic energy thereof is not derived from the coaxial connector 11a.

It should be noted here that the configuration of each of the loops 8a to 8c and 9a to 9c is not limited to the rectangular shape as illustrated in the foregoing embodiment, but may be modified to various shapes, for example, into a ring-like shape.

Figure 11:
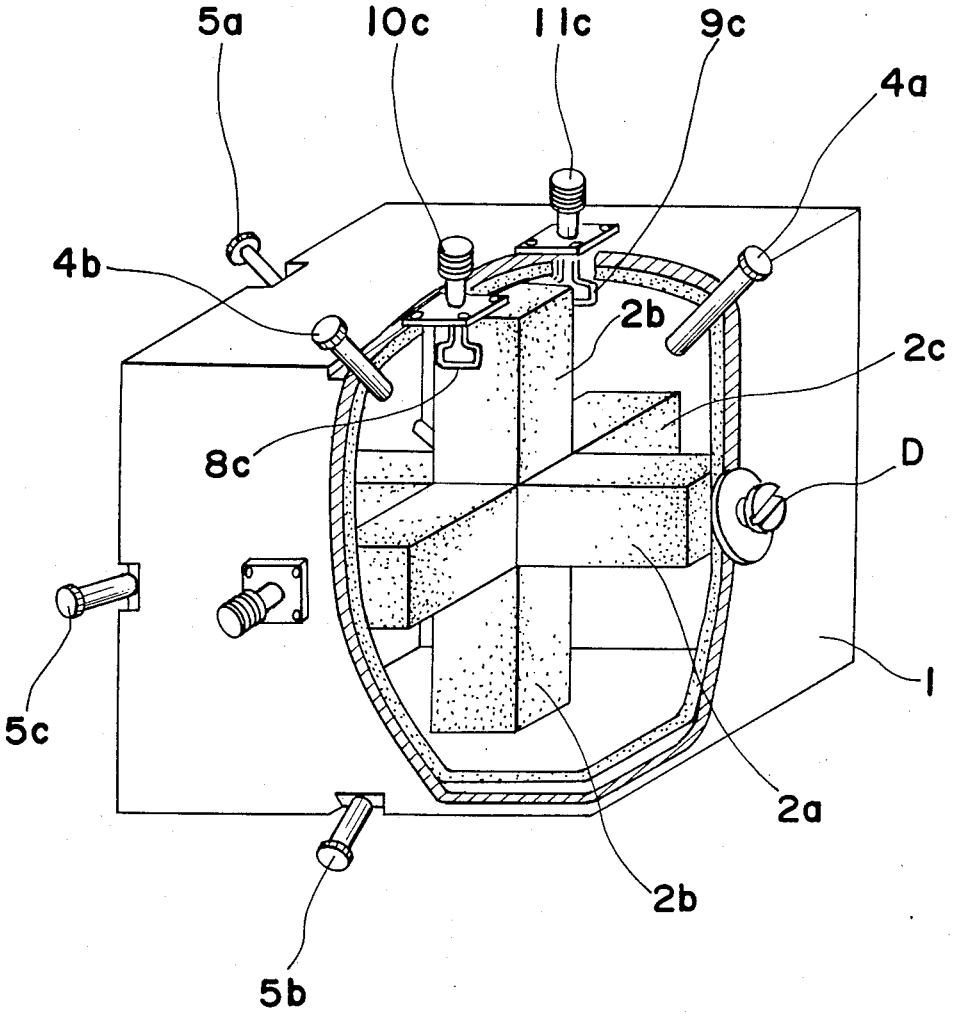
FIG. 11 is a perspective view partly broken away, showing appearance of an actual product of the device in FIG. 10.

FIG. 11 shows a general appearance of an actual product of the dielectric resonator device according to the present invention as described so far with reference to the foregoing embodiment, and provided with a frequency tuning dial D.

Figure 12:
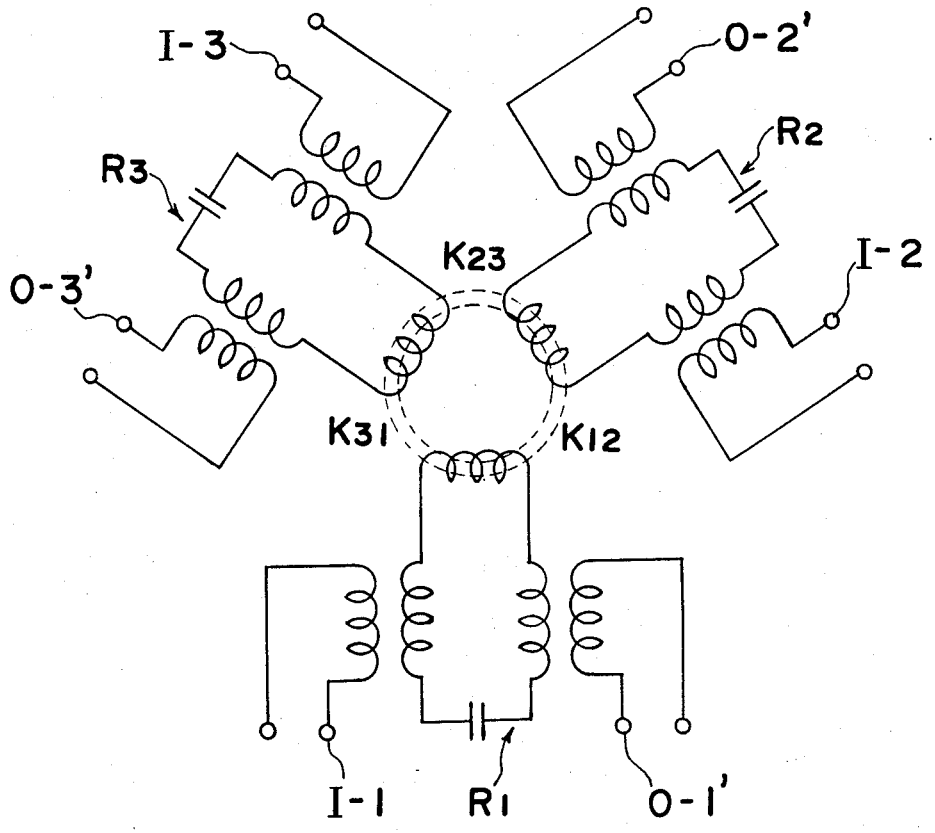
FIG. 12 is an electrical diagram showing an equivalent circuit of the device of FIG. 10.

Referring to FIG. 12, there is shown an equivalent electrical circuit diagram of the dielectric resonator device according to the embodiment of the present invention as described so far.

In FIG. 12, the resonator of the resonant mode related to the dielectric member 2a is represented by a symbol R1, the resonator of the resonant mode related to the dielectric member 2b is denoted by a symbol R2, and the resonator of the resonant mode related to the dielectric member 2c is shown by a symbol R3. Input and output ends of the filter constituted by the resonator R1 are respectively represented by I-1 and O-1', input and output ends of the filter constituted by the resonator R2 are denoted by I-2 and O-2', and input and output ends of the filter constituted by the resonator R3 are shown by I-3 and O-3'. Meanwhile, the coupling degree between the resonators R1 and R2 is denoted by K12, that between the resonators R2 and R3, by K23, and that between the resonators R3 and R1, by K31. Accordingly, if the coupling degrees K12, K23 and K31 are all rendered to be substantially zero by adjusting the coupling adjusting members referred to in FIG. 5, it is regarded that the three resonators electrically intersecting at right angles, but independent of each other in a state of non-interference, are constituted in one case. More specifically, by way of example, the signal applied to the input terminal I-1 is filtered and outputted only from the output end O-1', and the signal inputted to the output end I-2 is filtered and produced only from the output end O-2', while the signal applied to the input end I-3 is filtered to be derived only from the output end O-3'.

Figure 13:
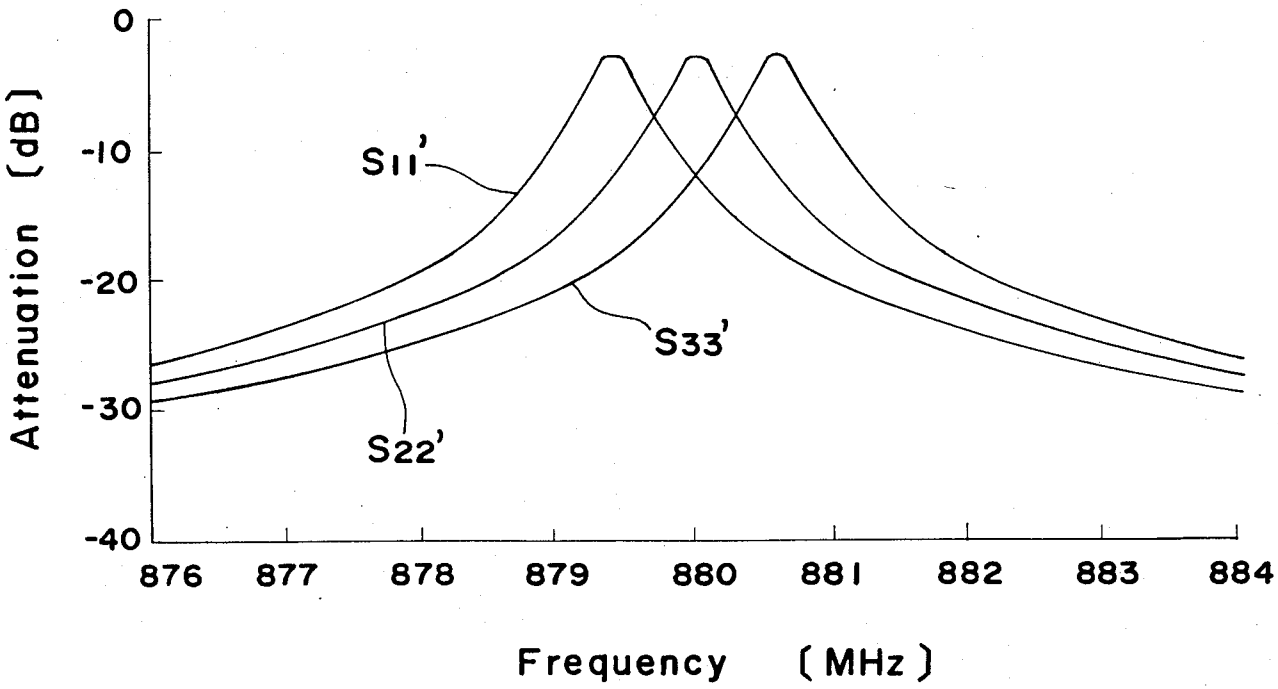
FIG. 13 is a filter characteristic diagram of the dielectric resonator device of the present invention.
Figure 14:
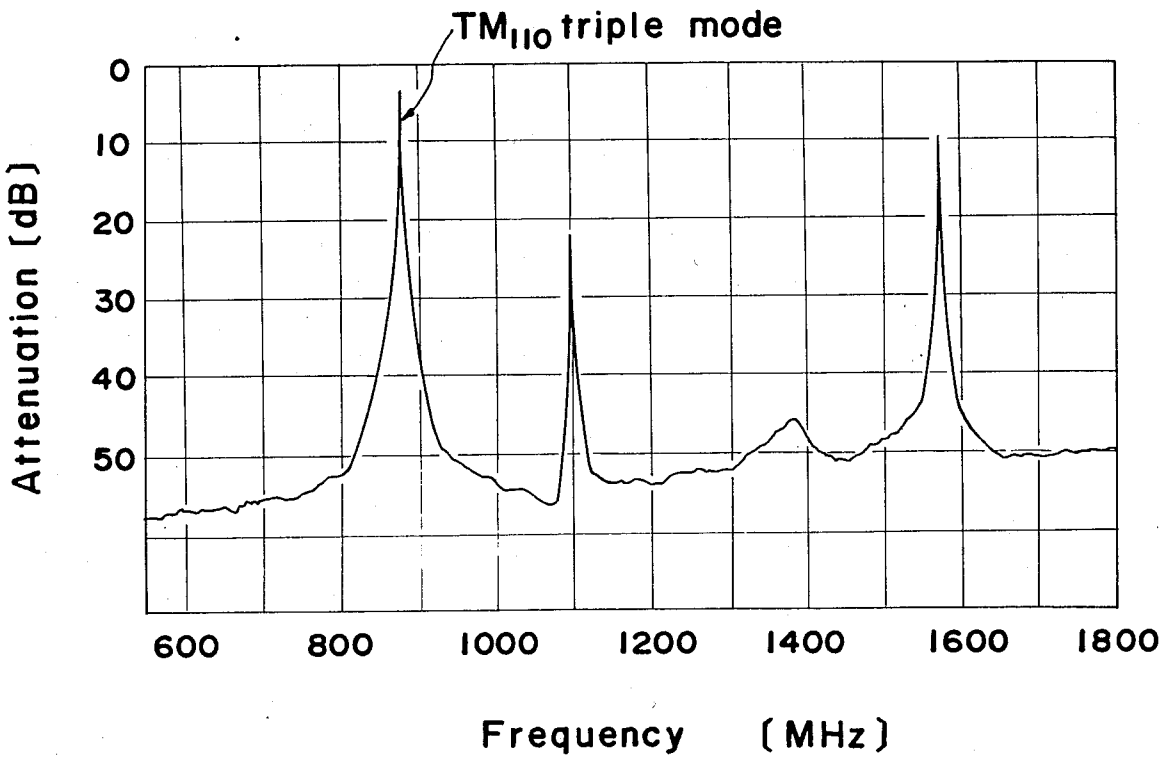
FIG. 14 is a spurious characteristic diagram of the dielectric channel dropping filter of the present invention.

FIGS. 13 and 14 show filter characteristics and spurious characteristics of the dielectric resonator device according to the present invention. In FIG. 13, S11' represents response between the input end I-1 and output end O-1', S22' shows response between the input end I-2 and output end O-2', and S33' denotes response between the input end I-3 and output end O-3'.

Figure 15:
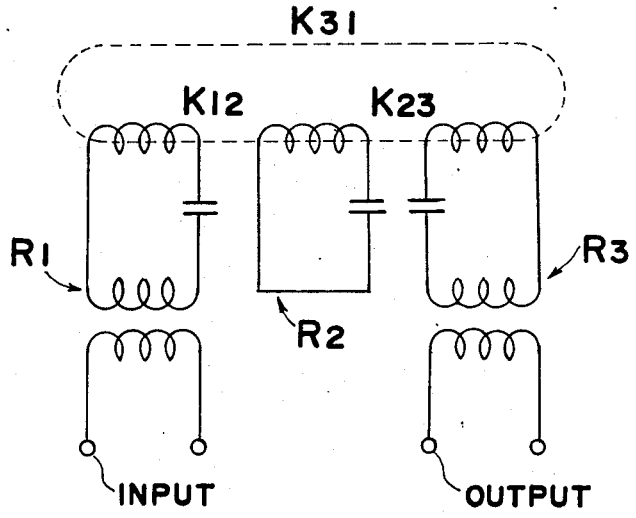
FIG. 15 is an electrical diagram showing an equivalent circuit when a three stage filter is constituted by the device of the present invention.

In the case where the filter is constituted through employment of three resonators, it is so arranged to couple them, for example, in the order of the resonators R1, R2 and R3, and an input coupling means such as the input coupling means having the loop 8a is combined with the resonator R1, while an output coupling means such as the output coupling means having the loop 9c is combined with the resonator R3, whereby an equivalent circuit as shown in FIG. 15 can be obtained. Thus, when the coupling degree K31 is rendered to be substantially zero by setting the coupling degrees K12 and K23 to proper values respectively through adjustment of the coupling adjusting members provided for each resonator as shown in FIG. 5, the signals applied to the input coupling means are successively filtered by the resonators R1, R2 and R3 so as to be outputted through the output coupling means, and thus, the filter without an attenuation pole whereat the amount of attenuation is the maximum is to be constituted in one casing. A filter having an attenuation pole may be provided if the coupling degree K31 is also set at a proper value.

As is seen from the foregoing embodiment, according to the present invention, since the three $TM_{110}$ modes or modified modes thereof intersecting at right angles with each other and present in the rectangular cavity shield casing are effectively utilized, the size of the device is reduced to $\frac{1}{3}$ of the conventional device, with a simultaneous reduction in cost, while the coupling with respect to the external circuits may be effected by the external coupling means with a simple construction.

Figure 16:
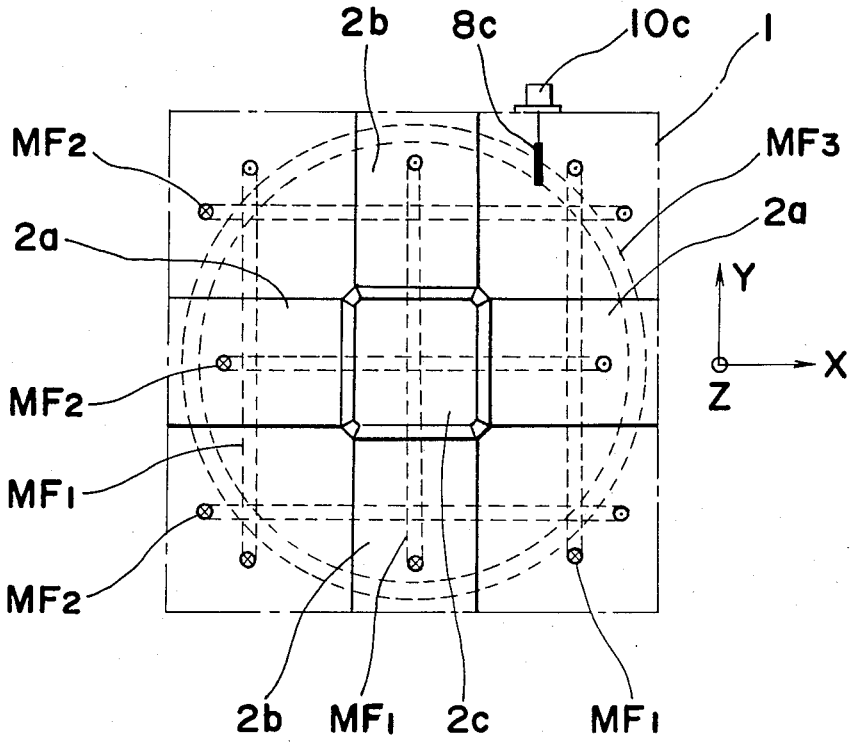
FIG. 16 is a diagram similar to FIG. 8, which particularly relates to a modified dielectric resonator device of the present invention.
Figure 17:
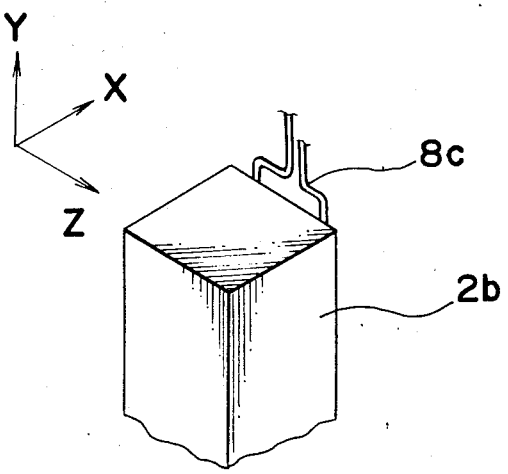
FIG. 17 is a fragmentary perspective view showing the magnetic coupling loop in the arrangement of FIG. 16.
Figure 18:
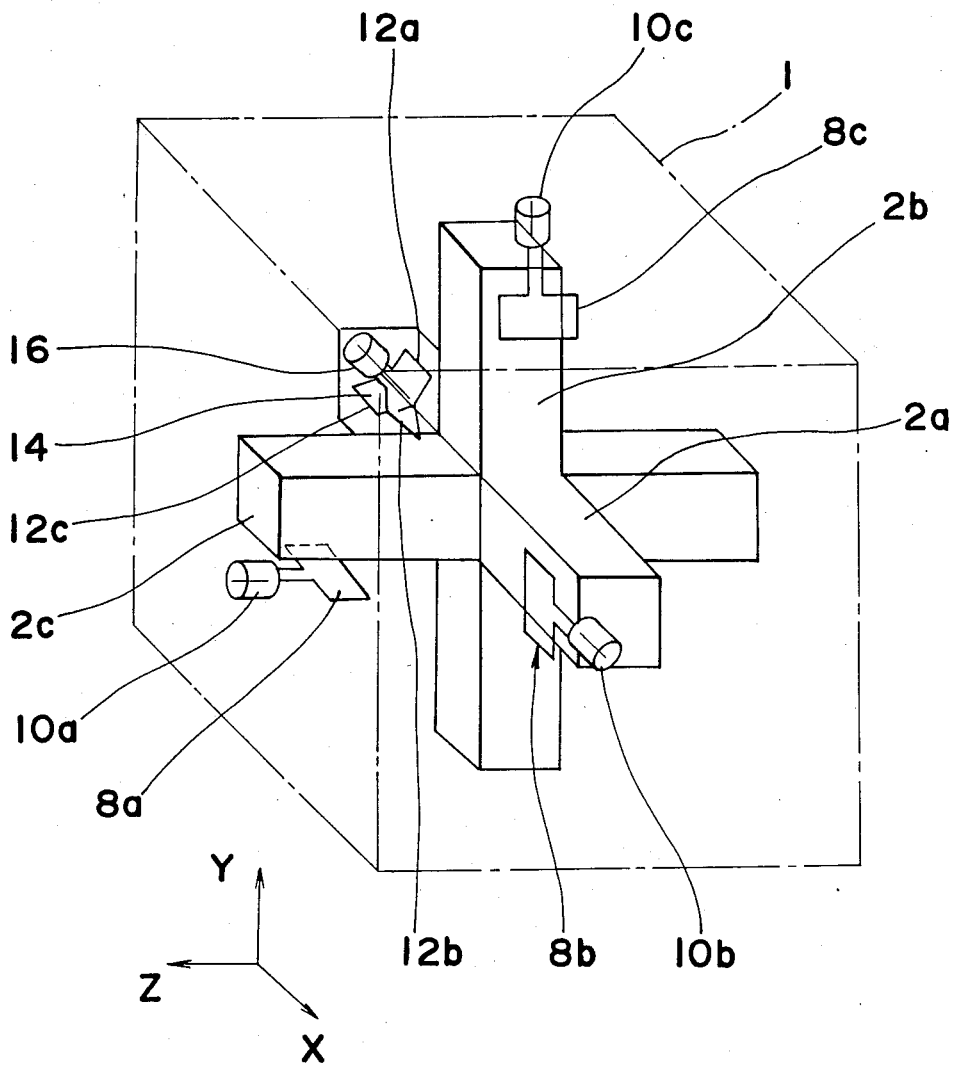
FIG. 18 is a perspective view showing internal construction of the dielectric resonator device of FIG. 16.

Referring to FIGS. 16 through 18, there is shown a modification of the dielectric resonator device as described so far with reference to FIGS. 8 through 15.

In the modified dielectric resonator device of FIGS. 16 to 18, the magnetic coupling loops 9 in FIGS. 8 through 15 are dispensed with, while loops 12*a*, 12*b* and 12*c* are provided for functioning in the manner as described hereinbelow.

Specifically, with the axial directions of the dielectric members 2*a*, 2*b* and 2*c* respectively aligned with X, Y and Z axes of the rectangular coordinate, the loop 8*c* is disposed adjacent to one end of the dielectric member 2*b* in a spaced relation from the surface of the dielectric member 2*b* in the direction of the X axis. In this case, the plane in which the loop 8*c* is included is direction to intersect at right angles with the X axis. One end of the loop 8*c* is connected, for example, to the central conductor of the coaxial connector 10*c*, while the other end thereof is connected to the ground. By the input signal applied to the input coaxial connector 10*c*, electric current flows through the loop 8*c*, and upon observation of the direction of the magnetic lines of force thus produced, direction of magnetic lines of force MF1 of the resonant mode related to the dielectric member 2*a*, direction of magnetic lines of force MF2 of the resonant mode related to the dielectric member 2*b*, and direction of magnetic lines of force MF3 of the resonant mode related to the dielectric member 2*c* respectively, only the magnetic lines of force MF3 have the same direction component for coupling. Accordingly, in the case where the frequency component of the resonant mode related to the dielectric member 2*c* is present in the signal applied to the input coaxial connector 10*c*, the resonance phenomenon takes place.

Similar coupling means is also provided with respect to the dielectric member 2*b*. The loop 8*b* is disposed adjacent to one end of the dielectric member 2*a* in a spaced relation from the surface of said dielectric member 2*a* in the direction of the Z axis. In this case, the planes in which the loop 8*b* is included, is directed to intersect at right angles with the Z axis. One end of the loop 8*b* is connected, for example, to a central conductor of a coaxial connector 10*b*, while the other end thereof is connected to the ground. By the input signal applied to the input coaxial connector 10*b*, electric current flows through the loop 8*b*, and upon observation of the direction of the magnetic lines of force thus produced, direction of magnetic lines of force MF1 of the resonant mode related to the dielectric member 2*a*, direction of magnetic lines of force MF2 of the resonant mode related to the dielectric member 2*b*, and direction of magnetic lines of force MF3 of the resonant mode related to the dielectric member 2*c* respectively, only the magnetic lines of force MF2 have the same direction component for coupling. Accordingly, in the case where the frequency component of the resonant mode related to the dielectric member 2*a* is present in the signal applied to the input coaxial connector 10*b*, the resonance phenomenon takes place.

Furthermore, another coupling means similar to the above is also provided with respect to the dielectric member 2*a*. The loop 8*a* is disposed adjacent to one end of the dielectric member 2*c* in a spaced relation from the surface of said dielectric member 2*c* in the direction of the Y axis. In this case, the plane in which the loop 8*a* is included, is directed to intersect at right angles with the Y axis. One end of the loop 8*a* is connected, for example, to a central conductor of a coaxial connector 10*a*, while the other end thereof is connected to the ground. By the input signal applied to the input coaxial connector 10*a*, electric current flows through the loop 8*a*, and upon observation of the direction of the magnetic lines of force thus produced, direction of magnetic lines of force MF1 of the resonant mode related to the dielectric member 2*a*, direction of magnetic lines of force MF2 of the resonant mode related to the dielectric member 2*b*, and direction of magnetic lines of force MF3 of the resonant mode related to the dielectric member 2*c* respectively, only the magnetic lines of force MF1 have the same direction component for coupling. Accordingly, in the case where the frequency component of the resonant mode related to the dielectric member 2*a* is present in the signal applied to the input coaxial connector 10*a*, the resonance phenomenon takes place.

Additionally, the loops 12*a*, 12*b* and 12*c* are provided in positions where they may be coupled to any of the magnetic lines of force MF1 of the resonant mode related to the dielectric member 2*a*, magnetic lines of force MF2 of the resonant mode related to the dielectric member 2*b*, and magnetic lines of force MF3 of the resonant mode related to the dielectric member 2*c*.

In the embodiment as shown in FIG. 18, the loops 12*a*, 12*b* and 12*c* are disposed in the vicinity of an angle portion 14 where three angled edges of the casing 1 are combined, and upon setting the plane including the loop 12*a* as an arbitrary first plane including the angle 14 and the center of the casing, the plane in which the loop 12*b* is included intersects said first plane through an intersecting angle of 120°, with its intersecting axis forming a second plane passing through the angle 14 and the center of the casing, while the plane in which the loop 12*c* is included intersects said first and second planes at an intersecting angle of 120°, with its intersecting axis forming a third plane passing through the angle 14 and the center of the casing. On end of each of the loops 12*a*, 12*b* and 12*c* is collected to be connected to a central conductor of a coaxial connector 16, with the other ends of the respective loops 12*a*, 12*b* and 12*c* being grounded. Any of the magnetic lines of force MF1, MF2 and MF3 interlink the loop 12*a*, and similarly, the loops 12*b* and 12*c*. Upon rotation of the loops 12*a*, 12*b* and 12*c* about the axis passing through the angle 14 and the center of the casing, output characteristics are varied. In this manner, the signals respectively applied to the coaxial connectors 10*a*, 10*b* and 10*c* are to be outputted from the coaxial connector 16.

It is to be noted here that the configuration of the loops 8*a* to 8*c* and 12*a* to 12*c* are not limited to those as illustrated, but may be modified, for example, into a ring-like shape.

Figure 19:
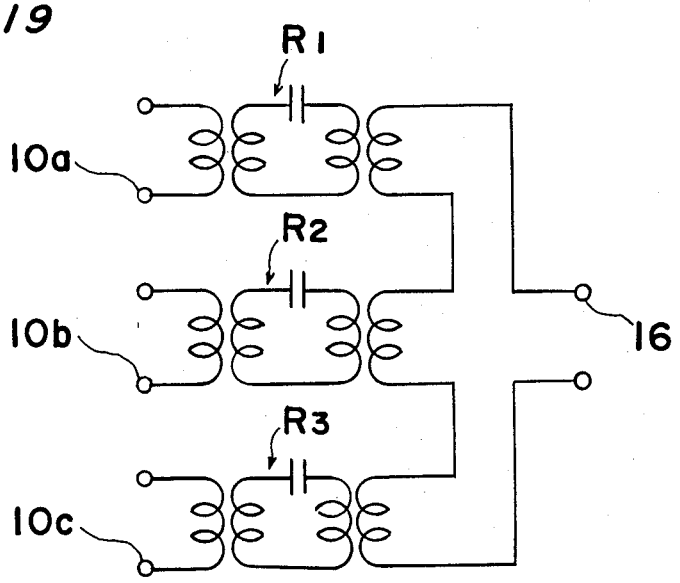
FIGS. 19 and 20 are electrical diagrams for explaining equivalent circuits for the dielectric resonator device of FIG. 16.
Figure 20:
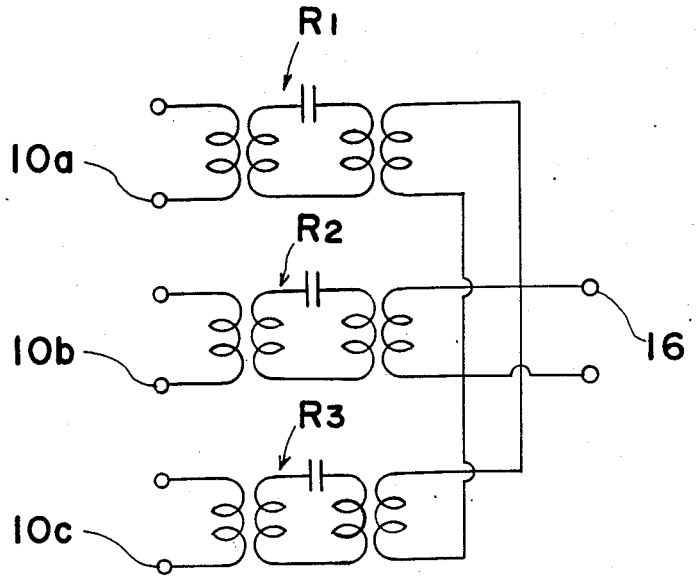
Figure 21:
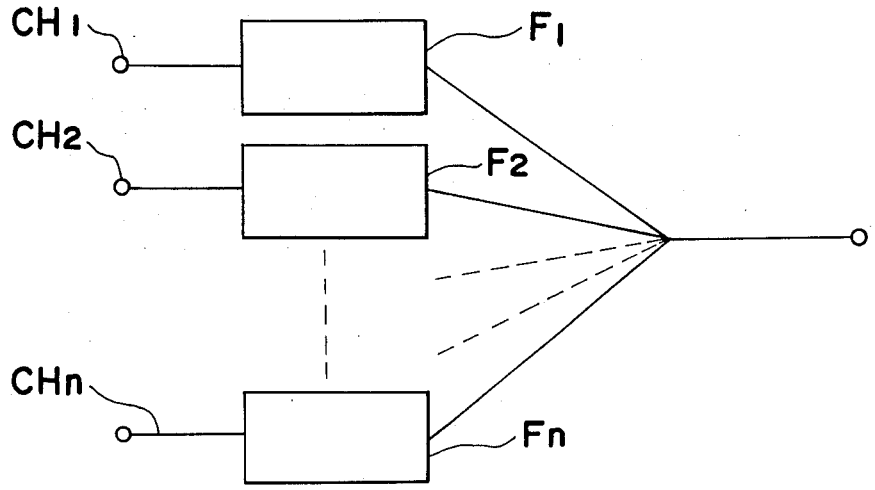
Fig. 21 PRIOR ART
FIG. 21 is a diagram showing construction of a conventional channel filter (already referred to)

The dielectric resonator device in the above embodiment is considered to be represented by a concentrated constant circuit as shown in FIG. 19 or 20, although it is not clear at present which is more faithful to the actual microwave circuit. In FIG. 19 or 20, the resonator for the resonant mode related to the dielectric member 2*a* is represented by R1, and the resonator for the resonant mode related to the dielectric member 2*b* is denoted by R2, while the resonator for the resonant mode related to the dielectric member 2*c* is shown by R3. Depending on necessity, there are cases where resonant frequencies of the respective resonators are adapted to be coincident with or to be differentiated from each other. Although the description of the above embodiment is effected on the assumption that the device is applied to a channel filter or powder composer, the dielectric resonator device of the present invention may also be used as a branching filter as well.

By the arrangement of the above embodiment of FIGS. 16 through 20, in addition to the advantage available in the embodiment of FIGS. 1 through 15, there is such a merit that since the power distribution and/or composing circuit is present in the casing, considerably small size may be achieved as compared with the conventional devices of this kind.

Figure 22:
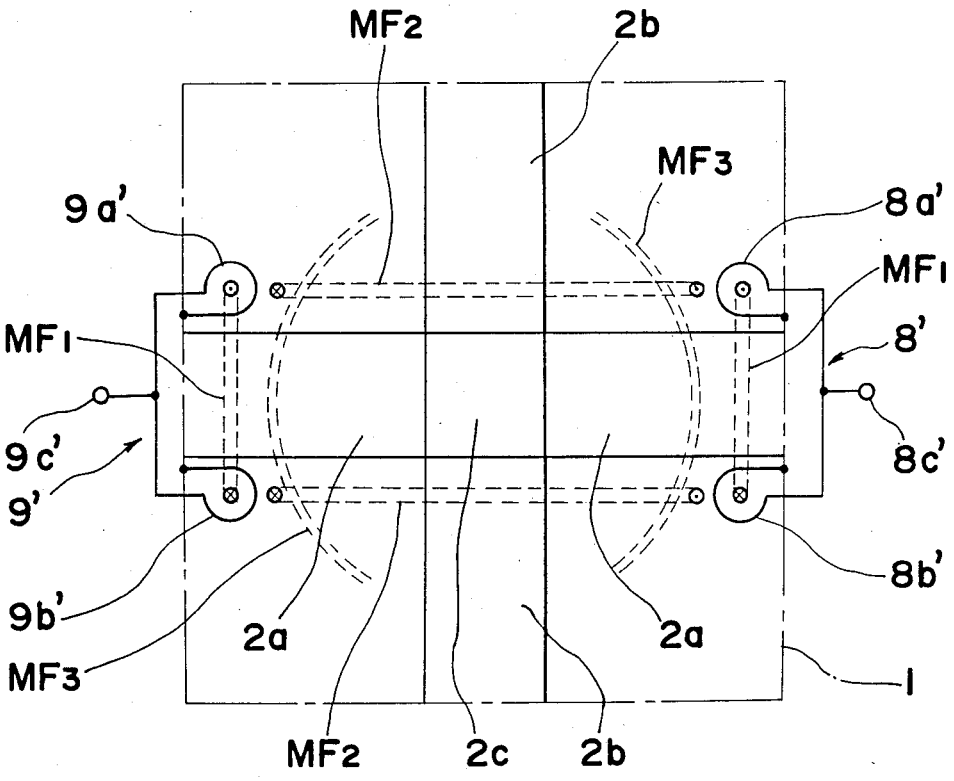
FIG. 22 is a diagram similar to FIG. 8, which particularly relates to another modified dielectric resonator device.

Referring further to FIG. 22, another modification of the dielectric resonator device described so far is given, in which there are representatively shown an input coupling means 8', and an output coupling means 9' which are coupled only with the dielectric member 2a. The input coupling means 8 has two coupling loops 8a' and 8b' disposed adjacent to one end of the dielectric member 2a, with said dielectric member 2a being held between said 8a' and 8b', and the plane in which the respective loops 8a' and 8b' are included is arranged to be aligned with the cross section of the dielectric member 2c. As one example, the ends of the respective loops 8a' and 8b' adjacent to the dielectric member 2a are grounded, while the other ends of said respective loops are formed into one piece at a portion of an equal electrical length to be conducted to an input terminal 8c'. By the input signal as applied to the input terminal 8c', electric current flows through the loops 8a' and 8b' in a state of the same phase, and the direction of magnetic lines of force produced in said loops coincides with the direction of the magnetic lines of force MF1 for the resonant mode related to the dielectric member 2a. Meanwhile, upon observation of the relation between the direction of the magnetic lines of force produced in the loop 8a' and that of the magnetic lines of force MF2 for the resonant mode related to the dielectric member 2b, and also, the relation between the direction of the magnetic lines of force produced in the loop 8b' and that of said magnetic lines of force MF2, it is seen that on the one hand, the relation is in the same direction, while on the other hand, the relation is in the opposite direction. Moreover, since the respective coupling degrees are arranged to be the same, such coupling degrees becomes zero after all. Furthermore, the magnetic lines of force produced in the loops 8a' and 8b' do not have the same direction component as that of the magnetic lines of force MF3 of the resonant mode related to the dielectric member 2c. In other words, these magnetic lines of force intersect at right angles with each other, and thus, they are not coupled with each other.

Similarly, the output coupling means 9' has two coupling loops 9a' and 9b' disposed adjacent to the other end of the dielectric member 2a, with said dielectric member 2a being held between said loops 9a' and 9b', and the plane in which the respective loops 9a' and 9b' are included is arranged to be aligned with the cross section of the dielectric member 2c. As one example, the ends of the respective loops 9a' and 9b' adjacent to the dielectric member 2a are grounded, while the other ends of said respective loops are formed into one piece at a portion of an equal electrical length to be conducted to an output terminal 9c'. Since the output signals produced by the interlinking of the magnetic lines of force MF1 for the resonant mode related to the dielectric member 2a and the loops 9a' and 9b' are combined at the same phase, they are outputted from the output terminal 9c'. Although the magnetic lines of force MF2 for the resonant mode related to the dielectric member 2b and the loops 9a' and 9b' interlink each other, they are combined in opposite phase, and thus, no output is produced at the output terminal 9c'. Moreover, since the magnetic lines of force MF3 for the resonant mode related to the dielectric member 2c and the loops 9a' and 9b' do not interlink each other, no output is produced from the output terminal 9c'. For coupling the resonant mode related to the dielectric member 2b with external circuits, the input coupling means and output coupling means similar to those in the case of the resonant mode related to the dielectric member 2a are to be provided adjacent to opposite ends of the dielectric member 2b. For coupling the resonant mode related to the dielectric member 2c with external circuits also, similar input coupling means and output coupling means are to be provided.

The dielectric resonator device as described so far with reference to FIG. 22 may be represented by the equivalent circuit diagram as shown in FIG. 12, and for the functioning of the circuit, reference should be made to the description given earlier with reference to FIG. 12.

As is clear from the foregoing description, according to the present invention, the three $TM_{110}$ modes or modified modes thereof intersecting at right angles with each other and present in the rectangular cavity shield casing are effectively utilized, and therefore, the size of the device may be reduced to a large extent as compared with conventional arrangements, with a simultaneous reduction in cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A dielectric resonator device which comprises dielectric resonators constituted by a rectangular cavity shield casing and a composite dielectric structure formed by three dielectric members intersecting at right angles with each other to be combined into one unit and disposed in said rectangular cavity shield casing to provide three resonances by $TM_{110}$ modes or modified modes thereof which are utilized by said dielectric resonators, and an external coupling means for coupling said dielectric resonators with external circuits.

2. A dielectric resonator device as claimed in claim 1, wherein at least two of said three resonances are in a state uncoupled to each other in actual use.

3. A dielectric resonator device as claimed in claim 2, wherein said uncoupled state is achieved by providing a member protruding into said shield casing between the dielectric members respectively related to the two resonances.

4. A dielectric resonator device as claimed in claim 1, wherein at least two of said three resonances are in a state coupled to each other.

5. A dielectric resonator device as claimed in claim 4, wherein said coupled state is achieved by providing a member protruding into said shield casing between the dielectric members respectively related to the two resonances.

6. A dielectric resonator device as claimed in claim 1, wherein said external coupling means includes an input coupling means and an output coupling means each having a pair of magnetic coupling loops branched from a transmission line in said shield casing, said input coupling means being so arranged that a direction of magnetic lines of force produced in each of said magnetic coupling loops is coincident with that of magnetic lines of force of the resonant mode to be coupled for effecting the coupling, and upon observation of the direction of the magnetic lines of force of one resonant mode of two remaining resonant modes not to be coupled and the direction of the magnetic lines of force produced in each of said pair of the magnetic coupling loops, one of the magnetic lines of force produced in each of said pair of magnetic coupling loops is in the same direction as one of the two resonant modes not to be coupled, whereas the other of the magnetic lines of force produced in each of said pair of magnetic coupling loops is in an opposite direction to the one of the two resonant modes not to be coupled, and also that, the degree of coupling between the one of the two resonant modes not to be coupled and the magnetic line of force produced in each of said pair of the magnetic coupling loops is equal for effecting the coupling, and further that, upon observation of the direction of the magnetic lines of force of the other resonant mode of the two resonant modes not to be coupled and the direction of the magnetic lines of force produced in each of said pair of the magnetic coupling loops, it is intended not to effect the coupling by adapting that none of the magnetic lines of force produced in each of said pair of magnetic coupling loops has a vector component in a direction coinciding with the direction of the magnetic lines of force of the other resonant mode of the two resonant modes not to be coupled, said output coupling means being so arranged that each of said pair of magnetic coupling loops interlinks the magnetic lines of force of the resonant mode to be coupled, with the outputs produced respectively being adapted to be composed in the same phase, thereby to take out the output, and also that, although the magnetic lines of force of the one resonant mode of the two remaining resonant modes not to be coupled intersect each of said pair of magnetic coupling loops, the outputs produced thereby are composed in the opposite phase for cancelling the outputs, with the magnetic lines of force of the other resonant mode of said two resonant modes not to be coupled, not interlinking any of said pair of magnetic coupling loops.

7. A dielectric resonator device as claimed in claim 1, wherein said rectangular cavity shield casing is made of a material having substantially the same thermal expansion coefficient as that of said dielectric members provided therein.

8. A dielectric resonator device as claimed in claim 7, wherein said rectangular cavity shield casing includes a cavity rectangular member formed by the same material as that of the dielectric members disposed therein, and a shield electrode film provided on an inner surface or outer surface of said cavity rectangular member.

9. A dielectric resonator device as claimed in claim 1, wherein said external coupling means further includes a first external coupling means coupled with the first dielectric resonator, a second external coupling means coupled with the second dielectric resonator, a third external coupling means coupled with the third dielectric resonator, and a fourth external coupling means coupled with said first, second and third dielectric resonators.

10. A dielectric resonator device as claimed in claim 1, wherein said external coupling means further includes an input coupling means and an output coupling means each having magnetic coupling loops, said input coupling means being so arranged that a direction of magnetic lines of force generated in the loop is coincident with that of magnetic lines of force of the resonant mode to be coupled, said output coupling means being so adapted that the loop interlinks the magnetic lines of force of the resonant mode to be coupled.

* * * * *